US008714553B2

(12) United States Patent
Hong et al.

(10) Patent No.: US 8,714,553 B2
(45) Date of Patent: May 6, 2014

(54) METHOD, APPARATUS, AND COMPUTER READABLE STORAGE FOR IMPLEMENTING A SIDE WAGER FOR A BLACKJACK GAME

(76) Inventors: Hwei-Wen Wayne Hong, Alameda, CA (US); Ivan Hong, Alameda, CA (US)

( * ) Notice: Subject to any disclaimer, the term of this patent is extended or adjusted under 35 U.S.C. 154(b) by 184 days.

(21) Appl. No.: 12/907,976

(22) Filed: Oct. 19, 2010

(65) Prior Publication Data

US 2011/0316233 A1 Dec. 29, 2011

Related U.S. Application Data

(60) Provisional application No. 61/398,271, filed on Jun. 23, 2010, provisional application No. 61/399,299, filed on Jul. 9, 2010, provisional application No. 61/400,532, filed on Jul. 28, 2010, provisional application No. 61/404,940, filed on Oct. 12, 2010.

(51) Int. Cl.
*A63F 1/00* (2006.01)

(52) U.S. Cl.
USPC ..... 273/292

(58) Field of Classification Search
None
See application file for complete search history.

(56) References Cited

U.S. PATENT DOCUMENTS 5,174,579 A * 12/1992 Griffiths ..... 273/292
5,275,416 A * 1/1994 Schorr et al. ..... 273/292
5,454,570 A * 10/1995 Karal ..... 273/292
5,632,485 A * 5/1997 Woodland et al. ..... 273/292
5,816,575 A * 10/1998 Keller ..... 273/292
5,829,750 A * 11/1998 Booker ..... 273/292
5,839,730 A * 11/1998 Pike ..... 273/292
6,000,699 A * 12/1999 Long ..... 273/292
6,012,719 A * 1/2000 Webb ..... 273/292
6,237,917 B1 * 5/2001 Timpano ..... 273/292
6,450,500 B1 * 9/2002 Miller ..... 273/292
6,598,879 B2 * 7/2003 Spur et al. ..... 273/292
6,604,741 B1 * 8/2003 Snow ..... 273/292
6,659,461 B2 * 12/2003 Yoseloff et al. ..... 273/274
6,808,173 B2 * 10/2004 Snow ..... 273/292
6,874,786 B2 * 4/2005 Bruno et al. ..... 273/292
7,255,351 B2 * 8/2007 Yoseloff et al. ..... 273/274
7,651,096 B2 * 1/2010 Friedman ..... 273/292
7,722,047 B2 * 5/2010 Walker et al. ..... 273/292
8,286,967 B2 * 10/2012 Sparago ..... 273/292
8,337,285 B2 * 12/2012 Cranford ..... 463/12
8,360,434 B2 * 1/2013 Smith et al. ..... 273/292
8,371,917 B2 * 2/2013 Hall ..... 463/12
8,382,114 B2 * 2/2013 Johnston ..... 273/292
8,382,568 B2 * 2/2013 Hall ..... 463/12
2003/0222400 A1 * 12/2003 Collins et al. ..... 273/274
2008/0203665 A1 * 8/2008 Simpson ..... 273/292

* cited by examiner

*Primary Examiner* — Kurt Fernstrom
*Assistant Examiner* — Dolores Collins
(74) *Attorney, Agent, or Firm* — Muskin & Farmer LLC

(57) ABSTRACT

A method, apparatus, and computer readable storage to implement a side bet for a blackjack game. If the player's initial two cards have a point total under 10, then the player wins a first payout on the side wager, otherwise the player loses the side wager. Then, the blackjack game is completed, and if the player won the first payout and the player wins the blackjack game then the player wins a second payout on the side wager. If the player won the first payout and the player loses the blackjack game then the player loses the side wager.

18 Claims, 4 Drawing Sheets

SUMMARY REPORT for MATHEMATICAL ANALYSIS

Proposed Shortie Payout Tables for 2 Decks Blackjack

| Shortie | Hit Rate | Payout A | Sub-Net |
|---|---|---|---|
| A-A Suited | 0.075365% | 10 | 0.7536% |
| A-A Unsuited | 0.451064% | 5 | 2.2553% |
| Others | 20.794542% | 3 | 62.3836% |
| **Shortie Total** | **21.320971%** | | |
| 10 or Higher | 78.679029% | -1 | -78.6790% |
| **Blackjack W+2, L-1** | | | **6.8853%** |
| **House Advantage** | | | **6.4011%** |

| Shortie | Hit Rate | Payout B | Sub-Net |
|---|---|---|---|
| Any Shortie | 21.320971% | 3 | 63.9629% |
| **Shortie Total** | **21.320971%** | | |
| 10 or Higher | 78.679029% | -1 | -78.6790% |
| **Blackjack W+2, L-1** | | | **6.8853%** |
| **House Advantage** | | | **7.8308%** |

| Shortie | Hit Rate | Payout C | Sub-Net |
|---|---|---|---|
| A-A+A Suited | --- | --- | --- |
| A-A+A Unsuited | 0.030945% | 30 | 0.9284% |
| A-A Suited | 0.070908% | 10 | 0.7091% |
| A-A Unsuited | 0.424576% | 5 | 2.1229% |
| Others | 20.794542% | 3 | 62.3836% |
| **Shortie Total** | **21.320971%** | | |
| 10 or Higher | 78.679029% | -1 | -78.6790% |
| **Blackjack W+2, L-1** | | | **6.8853%** |
| **House Advantage** | | | **5.6498%** |

| Shortie | Hit Rate | Payout D | Sub-Net |
|---|---|---|---|
| A-A+A Diamonds | --- | --- | --- |
| A-A+A Suited | --- | --- | --- |
| A-A+A Unsuited | 0.030945% | 30 | 0.9284% |
| A-A Suited | 0.070908% | 10 | 0.7091% |
| A-A Unsuited | 0.424576% | 5 | 2.1229% |
| Others | 20.794542% | 3 | 62.3836% |
| **Shortie Total** | **21.320971%** | | |
| 10 or Higher | 78.679029% | -1 | -78.6790% |
| **Blackjack W+2, L-1** | | | **6.8853%** |
| **House Advantage** | | | **5.6498%** |

| Shortie | Hit Rate | Payout E | Sub-Net |
|---|---|---|---|
| A-A Suited | 0.075365% | 15 | 1.1305% |
| A-A Unsuited | 0.451064% | 5 | 2.2553% |
| Others | 20.794542% | 3 | 62.3836% |
| **Shortie Total** | **21.320971%** | | |
| 10 or Higher | 78.679029% | -1 | -78.6790% |
| **Blackjack W+2, L-1** | | | **6.8853%** |
| **House Advantage** | | | **6.0243%** |

Proposed Shortie Payout Tables for 6 Decks Blackjack

| Shortie | Hit Rate | Payout A | Sub-Net |
|---|---|---|---|
| A-A Suited | 0.123811% | 10 | 1.2381% |
| A-A Unsuited | 0.446057% | 5 | 2.2303% |
| Others | 20.740970% | 3 | 62.2229% |
| **Shortie Total** | **21.310838%** | | |
| 10 or Higher | 78.689162% | -1 | -78.6892% |
| **Blackjack W+2, L-1** | | | **6.8166%** |
| **House Advantage** | | | **6.1813%** |

| Shortie | Hit Rate | Payout B | Sub-Net |
|---|---|---|---|
| Any Shortie | 21.310838% | 3 | 63.9325% |
| **Shortie Total** | **21.310838%** | | |
| 10 or Higher | 78.689162% | -1 | -78.6892% |
| **Blackjack W+2, L-1** | | | **6.8166%** |
| **House Advantage** | | | **7.9400%** |

| Shortie | Hit Rate | Payout C | Sub-Net |
|---|---|---|---|
| A-A+A Suited | 0.001584% | 50 | 0.0792% |
| A-A+A Unsuited | 0.038899% | 30 | 1.1670% |
| A-A Suited | 0.115015% | 10 | 1.1501% |
| A-A Unsuited | 0.414370% | 5 | 2.0718% |
| Others | 20.740970% | 3 | 62.2229% |
| **Shortie Total** | **21.310838%** | | |
| 10 or Higher | 78.689162% | -1 | -78.6892% |
| **Blackjack W+2, L-1** | | | **6.8166%** |
| **House Advantage** | | | **5.1815%** |

| Shortie | Hit Rate | Payout D | Sub-Net |
|---|---|---|---|
| A-A+A Diamonds | 0.000402% | 200 | 0.0803% |
| A-A+A Suited | 0.001183% | 100 | 0.1183% |
| A-A+A Unsuited | 0.038899% | 30 | 1.1670% |
| A-A Suited | 0.115015% | 10 | 1.1502% |
| A-A Unsuited | 0.414371% | 5 | 2.0719% |
| Others | 20.741054% | 3 | 62.2232% |
| **Shortie Total** | **21.310522%** | | |
| 10 or Higher | 78.689478% | -1 | -78.6895% |
| **Blackjack W+2, L-1** | | | **6.8166%** |
| **House Advantage** | | | **5.0621%** |

| Shortie | Hit Rate | Payout E | Sub-Net |
|---|---|---|---|
| A-A Suited | 0.123811% | 15 | 1.8572% |
| A-A Unsuited | 0.446057% | 5 | 2.2303% |
| Others | 20.740970% | 3 | 62.2229% |
| **Shortie Total** | **21.310838%** | | |
| 10 or Higher | 78.689162% | -1 | -78.6892% |
| **Blackjack W+2, L-1** | | | **6.8166%** |
| **House Advantage** | | | **5.5622%** |

Proposed Shortie Payout Tables for 8 Decks Blackjack

| Shortie | Hit Rate | Payout A | Sub-Net |
|---|---|---|---|
| A-A Suited | 0.130020% | 10 | 1.3002% |
| A-A Unsuited | 0.445339% | 5 | 2.2267% |
| Others | 20.730987% | 3 | 62.1930% |
| **Shortie Total** | **21.306347%** | | |
| 10 or Higher | 78.693653% | -1 | -78.6937% |
| **Blackjack W=2, L-1** | | | **6.8057%** |
| **House Advantage** | | | **5.1681%** |

| Shortie | Hit Rate | Payout B | Sub-Net |
|---|---|---|---|
| Any Shortie | 21.306347% | 3 | 63.9190% |
| **Shortie Total** | **21.306347%** | | |
| 10 or Higher | 78.693653% | -1 | -78.6937% |
| **Blackjack W=2, L-1** | | | **6.8057%** |
| **House Advantage** | | | **7.9689%** |

| Shortie | Hit Rate | Payout C | Sub-Net |
|---|---|---|---|
| A-A+A Suited | 0.001885% | 50 | 0.0942% |
| A-A+A Unsuited | 0.039844% | 30 | 1.1953% |
| A-A Suited | 0.120599% | 10 | 1.2060% |
| A-A Unsuited | 0.413032% | 5 | 2.0652% |
| Others | 20.730987% | 3 | 62.1930% |
| **Shortie Total** | **21.306347%** | | |
| 10 or Higher | 78.693653% | -1 | -78.6937% |
| **Blackjack W=2, L-1** | | | **6.8057%** |
| **House Advantage** | | | **5.1343%** |

| Shortie | Hit Rate | Payout D | Sub-Net |
|---|---|---|---|
| A-A+A Diamonds | 0.000467% | 150 | 0.0701% |
| A-A+A Suited | 0.001418% | 80 | 0.1134% |
| A-A+A Unsuited | 0.039844% | 30 | 1.1953% |
| A-A Suited | 0.120599% | 10 | 1.2060% |
| A-A Unsuited | 0.413034% | 5 | 2.0652% |
| Others | 20.731084% | 3 | 62.1933% |
| **Shortie Total** | **21.305979%** | | |
| 10 or Higher | 78.694021% | -1 | -78.6940% |
| **Blackjack W=2, L-1** | | | **6.8057%** |
| **House Advantage** | | | **5.0450%** |

| Shortie | Hit Rate | Payout E | Sub-Net |
|---|---|---|---|
| A-A Suited | 0.130020% | 15 | 1.9503% |
| A-A Unsuited | 0.445339% | 5 | 2.2267% |
| Others | 20.730987% | 3 | 62.1930% |
| **Shortie Total** | **21.306347%** | | |
| 10 or Higher | 78.693653% | -1 | -78.6937% |
| **Blackjack W=2, L-1** | | | **6.8057%** |
| **House Advantage** | | | **5.5180%** |

FIGURE 4

METHOD, APPARATUS, AND COMPUTER READABLE STORAGE FOR IMPLEMENTING A SIDE WAGER FOR A BLACKJACK GAME

CROSS REFERENCE TO RELATED APPLICATIONS

This application claims benefit to provisional application 61/398,271, filed on Jun. 23, 2010, which is incorporated by reference herein in its entirety. This application also claims benefit to provisional application 61/399,299, filed on Jul. 9, 2010, which is incorporated by reference herein in its entirety. This application claims benefit to provisional application 61/400,532, filed on Jul. 28, 2010, which is incorporated by reference in its entirety for all purposes. This application also claims benefit to provisional application 61/404,940, filed on Oct. 11, 2010, which is incorporated by reference herein in its entirety.

BACKGROUND OF THE INVENTION

1. Field of the Invention

The present general inventive concept is directed to a method, apparatus, and computer readable storage medium directed to a casino wagering game.

2. Description of the Related Art

Blackjack is a well known casino game. Numerous blackjack side bets have been introduced in order to generate additional excitement for players as well as additional action (and hence profit) for the casino.

Prior art side bets such as "Lucky Ladies" resolve the side wager instantly when the player's initial cards are dealt. While popular and profitable, such side bets are resolved immediately which may cut short the player's additional excitement generated by the side bet.

What is needed is a side wager that is not always terminated after the initial deal, in order to provide prolonged excitement for the player and more entertainment value for the player's side wager.

SUMMARY OF THE INVENTION

It is an aspect of the present invention to provide an exciting casino wagering game.

The above aspects can be obtained by method that (a) providing a physical deck(s) of cards and a physical gaming table; (b) providing a first rule set, which comprises if a player's initial hand is in a predetermined set of winning hands then the player wins a first payout on the side wager and the side wager remains in play, and if the player's initial hand is not in the predetermined set of winning hands then the player loses the side wager and the side wager is removed from play; (c) providing a second rule set, which comprises if the player wins the main wager then the player wins a second payout on the side wager, and if the player loses the main wager then the player loses the side wager; (d) receiving a main wager from a player; (e) offering the player an option to place a side wager, and receiving the side wager if the player exercises the option; (f) dealing a player's initial two card hand and a dealer's initial hand; (g) resolving the side wager, if placed, based on the first rule set; (h) completing the blackjack game and resolving the main wager; and (i) resolving the side wager, if in play, using the second rule set.

The above aspects can also be obtained by an apparatus that includes (a) an electronic output device; (b) an electronic input device; (c) a processing unit adapted to operate with the output device and the input device, the processing unit executing instructions to perform: (d) providing a first rule set, which comprises if a player's initial hand is in a predetermined set of winning hands then the player wins a first payout on the side wager and the side wager remains in play, and if the player's initial hand is not in the predetermined set of winning hands then the player loses the side wager and the side wager is removed from play; (e) providing a second rule set, which comprises if the player wins the main wager then the player wins a second payout on the side wager, and if the player loses the main wager then the player loses the side wager; (f) receiving a main wager from a player; (g) offering the player an option to place a side wager, and receiving the side wager if the player exercises the option; (h) dealing a player's initial two card hand and a dealer's initial hand; (i) resolving the side wager, if placed, based on the first rule set; (j) completing the blackjack game and resolving the main wager; and (k) resolving the side wager, if in play, using the second rule set.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which:

FIG. 4 is an illustration of possible paytables that can be used with the side wager described herein, according to an embodiment.

DESCRIPTION OF THE PREFERRED EMBODIMENTS

Figure 1:
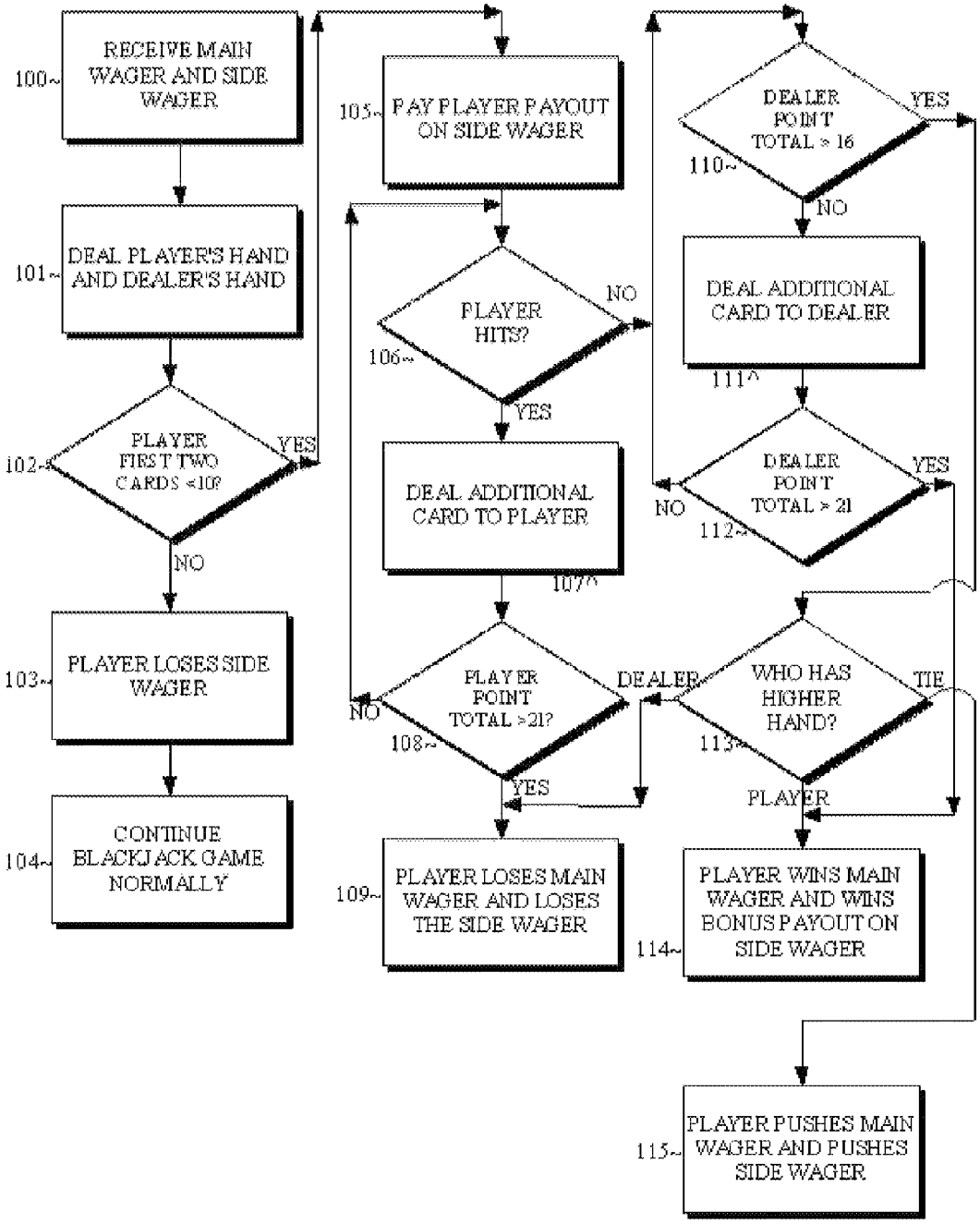
FIG. 1 is a flowchart illustrating an exemplary method to play a wagering game, according to an embodiment.

Reference will now be made in detail to the presently preferred embodiments of the invention, examples of which are illustrated in the accompanying drawings, wherein like reference numerals refer to like elements throughout.

The present inventive concept relates to a method, apparatus, and computer readable storage medium to implement a side wager for a blackjack game. Blackjack is known in the art and is described in U.S. patent publication 2003/0155715, which is incorporated by reference herein in its entirety. The side wager is optional and would typically be placed when the main blackjack wager is placed. The wager can be placed in any amount (within the set limits).

If the player's initial hand of two cards is less than a predetermined point total of 10 (or other point totals in other variations), the player wins a payout on the side wager immediately. If the point total of the initial two cards is not less than the predetermined point total, then the player loses the side wager and it is taken by the dealer (house). If the player wins the payout, then the player can also win a second payout on side wager contingent if the player wins the blackjack hand.

FIG. 1 is a flowchart illustrating an exemplary method to play a wagering game, according to an embodiment.

The method begins with operation 100, which receives the main wager and the side wager on the gaming table. This can be done by receiving wagers in the form of chips in respective betting circles on the table felt. The wagers need not be of equal value. The side wager is optional although for the purposes of FIG. 1 it is assumed that the player has made the side wager. The gaming can accommodate multiple simultaneous players as known in the art, although for simplicity this description assumes that there is only one player playing at a time.

From operation 100, the method proceeds to operation 101, wherein the dealer deals the player's initial hand (two cards face up or face down but viewable by the player) and the dealer's initial hand, one card face up (the "upcard") and one card face down (the "hole card").

From operation 101, the method proceeds to operation 102, which determines whether the point total of the player's first two cards is less than ten (10). A point total of less than 10 is also known herein as a "shortie." The possible hands that would total less than ten are: AA, A2, A3, A4, A5, A6, A7, A8, 22, 23, 24, 25, 26, 27, 33, 34, 35, 36, 44, and 45 (the order does not matter). In another embodiment, the player's point total would have to be less than a different point total (other than 10) to continue to operation 105.

If in operation 102, it is determined that the point total of the player's first two cards is not less than 10, then the method proceeds to operation 103, wherein the player loses the side wager. The side wager is typically taken by the dealer at this time.

From operation 103, the method proceeds to operation 104, which continues the blackjack game normally. This would be equivalent to performing operations 106-115 with the caveat that the side wager has already lost and taken by the dealer (and there is no additional payout on the side wager) and so any further reference to a side wager (operations 109, 114, 115) is ignored.

If in operation 102 it is determined that the player's point total of the first two cards is less than ten, then the method proceeds to operation 105, which pays an initial payout on the side wager. A paytable such as that in Table I can be used.

TABLE I

| Hand | Payout |
|---|---|
| 3-9 | 3 to 1 |
| AA, unsuited | 5 to 1 |
| AA, suited | 10 to 1 |
| AA, with dealer's ace up | |
| unsuited | 30 to 1 |
| suited | 100 to 1 |
| all diamonds | 200 to 1 |

In Table I, if the point total is from 3 to 9, the player wins a payout of 3:1. If the player has an unsuited point total of 2 (two aces of different suits) without a dealer's hole card being an ace then the player wins a payout of 5:1. If the player has a suited point total of 2 (two aces of the same suit) without a dealer's hold card being an ace then the player wins a payout of 10:1. If the player has a point total of 2 (two aces) with the dealer's hole card being an ace, then: if the player's two aces are unsuited (different suits) the player wins a payout of 30:1; if the player's two aces are suited (identical suits) then the player wins 100:1; and if the player's two aces are both diamonds then the player wins 200:1.

Of course, the paytable illustrated in Table I is just one example of a paytable and it can be appreciated by one in the art that other paytables can be used as well. See FIG. 4 for more examples of different paytables.

In operation 105, the appropriate payout is made on the side wager but the original side wager itself remains in play. For example, if the player bet $1 and has an initial point total of 9, then (according to Table I), the player is paid $3 (3:1) and the player's original $1 remains in play (stays in the side wager betting circle).

From operation 105, the method proceeds to operation 106 which determines whether the player takes a hit or not. Before the player takes action the dealer can also check for a blackjack (if an ace is showing) and ask for insurance, etc. The player makes this decision based on his or her two card initial hand and the dealer's up-card, and can indicate his or her choice of whether to take a hit verbally or by using hand signals. In an electronic version of the game, the player indicates his or her choice by pressing buttons, pointing/clicking a mouse, touching a screen, etc.

If in operation 106, the player decides to hit, then the method proceeds to operation 107, which deals an additional card to the player (face up).

From operation 107, the method proceeds to operation 108, which determines whether the player has a point total greater than 21 (busted). If the player's point total is less than 22, then the method returns to operation 106, wherein the player can take another hit (or not) at the player's option.

If in operation 108, the player has busted (has a point total greater than 21), then the method proceeds to operation 109, wherein the player loses the main wager and loses the side wager still in play. If there are no other live players, the dealer's hole-card can now be revealed to satisfy the player's curiosity.

If in operation 106, the player decides not to hit (stands), then the dealer's two cards are revealed (not pictured) and the method proceeds to operation 110, which determines if the dealer's point total is greater than 16.

In operation 106, depending on house rules, the player may also be given the option to surrender their wager (and receive 50% of their wager back) and end the game. If the player exercises this option, the player loses the side wager. The player may also have the option to split his or her initial two cards. If the player splits, then the side wager would only be applied to the first of the two split hands (the first hand to receive the next card). The player may also have the option to double down, however, the side wager cannot be doubled and a double is treated as a hit (goes to operation 107) for purposes of resolving the side wager.

If in operation 110, it is determined that the dealer's point total is not greater than 16, then the method proceeds to operation 111, which deals an additional card to the dealer (face up).

From operation 111, the method proceeds to operation 112, which determines whether the dealer's point total is greater than 21 (the dealer busts). If not, then the method returns to operation 110.

If in operation 112, it is determined that the dealer has busted (has a point total greater than 21), then the method proceeds to operation 114, wherein the player wins the main wager (typically a 1:1 payout) and also wins a payout on the side wager (typically paid at 2:1).

If in operation 110, it is determined that the dealer's point total is greater than 16, then the method proceeds to operation 113, which compares the dealer's hand to the player's hand.

If in operation 113, it is determined that the dealer has the higher hand, then the method proceeds to operation 109, described above.

If in operation 113, it is determined that the player has the higher hand, then the method proceeds to operation 114, described above.

If in operation 113, it is determined that the player and the dealer tie (have equal point totals), then the method proceeds to operation 115 wherein both the main wager and the side wager pushes (neither wins nor loses). Both the main wager and the side wager remain on the table for the player to take back and possibly bet again on the next hand.

Figure 2A:
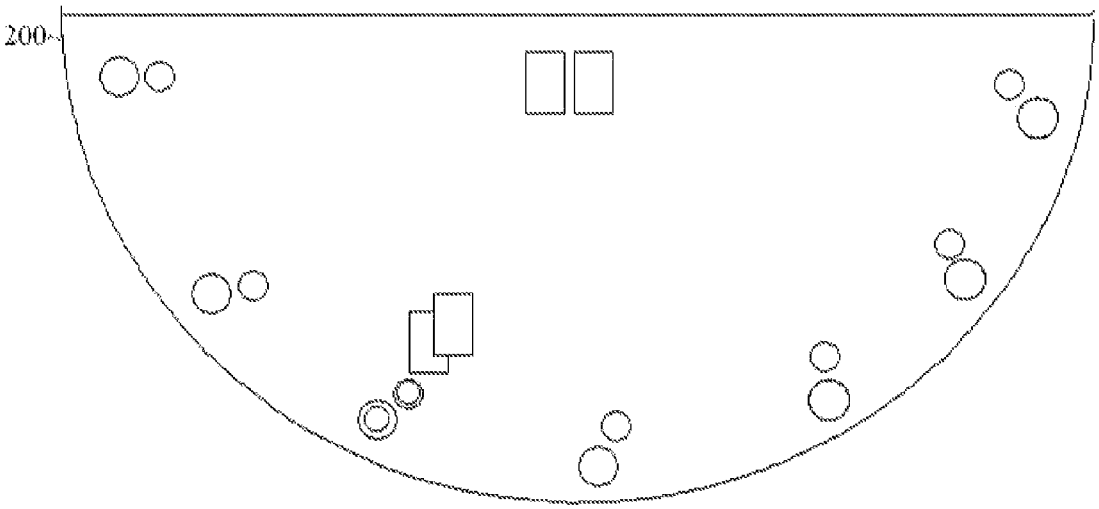
FIG. 2A is an exemplary table layout that can be used to implement wagering game, according to an embodiment.

FIG. 2A is an exemplary table layout that can be used to implement wagering game illustrated in FIG. 5, according to an embodiment.

A physical casino gaming table 200 is used to play the game and can accommodate multiple simultaneous players.

Figure 2B:
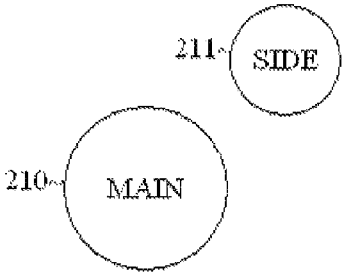
FIG. 2B is an exemplary betting layout used for each player, according to an embodiment.

FIG. 2B is an exemplary betting layout used for each player in FIG. 6A, according to an embodiment.

A main wager betting circle 210 is used to place the main wager (in operation 100) and a side wager betting circle 211 is used to place the side wager (in operation 100).

All methods described herein can be played on an electronic gaming device (EGD) or on a personal computer running the game which is served from an Internet (or online) casino.

Figure 3A:
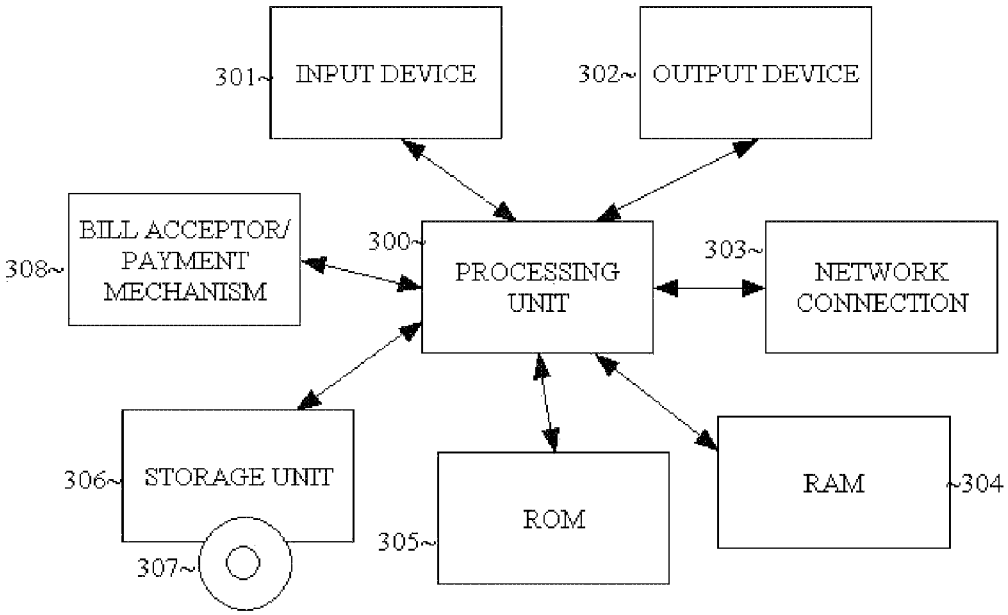
FIG. 3A is a block diagram of hardware comprising an electronic gaming machine to implement the methods described herein.

FIG. 3A is a block diagram of hardware comprising an electronic gaming machine to implement the methods described herein.

A processing unit 300 can be a microprocessor and associated structure (e.g., cache, bus, etc.) The processing unit 300 can be connected to an input device 301 (such as a touch-screen, keyboard, mouse, etc.), an output device (such as a touch-screen, speakers, LCD display, etc.), a network connection 303 (to connected to a computer communications network such as the Internet, LAN, WAN, etc.), a RAM 304, a ROM 305, a storage unit (such as a DVD-drive, CD-ROM, EPROM, Hard drive, etc.). A computer readable storage medium 307 (e.g., hard drive, CD, DVD, etc.) can be read by the storage unit 306 and can be used to store any and all assets needed to implement the methods described herein on the hardware, including programs to control the processing unit 300 to execute the methods, and game assets (e.g., video, images, sounds, etc.) The processing unit 300 can also be connected to a bill acceptor/payment mechanism 308 which can receive cash and credit the cash to the machine so the player can wager with the inserted cash. A player can also use electronic funds to credit the machine to wager. The payment mechanism 308 can also allow the player to cash out whatever credits the player has on the machine (either in cash, coins, electronic funds, a cashless ticket, etc.)

Figure 3B:
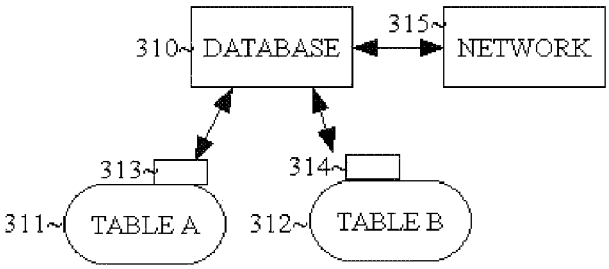
FIG. 3B is a block diagram of a group of gaming tables networked together with access to a player database, according to an embodiment.

FIG. 3B is a block diagram of a group of gaming tables networked together with access to a player database, according to an embodiment. It is common in casinos that the casino would track player play in order to provide incentives and complimentaries ("comps") to the players in order to encourage them to gamble. Players are given loyalty cards which contain a magnetically encoded identification number which allows the casino to track the player's play in a casino database. Dealer's or pit personnel observe the players at a table and periodically enter into a terminal (which is connected to the database) characteristics of the player's play (e.g., average bet amount and time of play).

A gaming table A 311 and a gaming table B 312 are physical gaming tables with electronic card readers 313 and 314 respectively. The electronic card readers can read an electronically encoded players code (such as with a magnetic stripe) and transmit the code to the electronic database 810 so that the respective player's play can be tracked. The electronic database 310 (such as an SQL database) which can archive play data from players and associate the play with each player's identification number. The data in the electronic database 310 can be retrieved by casino personnel at a later point in time in order to make decisions about whether to (and how much) award players complimentaries. The electronic database 310 is connected to a network connector or hub 315 which allows other computers in the casino (or casino property group) to access the database 310.

It is noted that the methods described herein can also be played on a live casino table using individual betting stations for the side wager for each player as described in U.S. Pat. No. 6,929,264 which is incorporated by reference herein in its entirety. This system is also available from DEQ Digital Entertainment known as the G3 product. With this type of system, each player has their own individual betting station with an individual display (LED or other output device) with buttons which allows the player to indicate an amount of their side wager. After the game is dealt, the dealer indicates (using buttons) the outcome of the game and each individual betting station (which is participating in the side bet) reflects a gain or loss depending on the outcome. Initially, the player can give cash (or chips) to the dealer so that the individual betting station can be initially funded and reflect an amount of credits (or dollars) the player cashed in for. In this way, the dealer is freed up from having to manipulate chips (take, pay, etc.) for each individual side wager. The player can use standard chips to place bets for the main wager alongside the "virtual" bets for the side wager.

A few examples of the game will now be presented to illustrate the method. Joe places a $1 main wager and a $1 side wager. Joe is dealt an ace-spades/nine-hearts. Joe's point total is 10 (aces count as one for the side bet) and thus Joe immediately loses the side wager (which is collected by the dealer). The blackjack game continues as any normal blackjack game does. For example, the dealer's up-card is a eight-spades. Joe stands, the dealer reveals the dealer's hole card as a ten-hearts. Thus, Joe's final point total of 20 (the ace counts as 11 here) which beats the dealer's point total of 18. Thus Joe wins $1 on the main wager, but since Joe lost $1 on the side wager Joe breaks even on the game.

Jack places a $1 main wager and a $1 side wager. Jack is dealt an ace-spades/nine-hearts. Jack's point total is 10 (aces count as one for the side bet) and thus Jack immediately loses the side wager (which is collected by the dealer). The blackjack game continues as any normal blackjack game does. The dealer's up-card is a eight-spades. Jack stands, the dealer reveals the dealer's hole card as a five-hearts. The dealer hits (since the dealer's point total is under 17) and receives a 8-diamonds. Since the dealer's point total (21) is higher than Jack's point total (20), Jack loses the main wager. Thus, Jack loses $1 on the main wager and also lost $1 on the side wager, for a total loss of $2.

Jane places a $1 main wager and a $1 side wager. Jane is dealt a 3-hearts/3-diamonds. Jane's point total is 6, which since it is under 10, wins a payout of $3. The side wager remains in play. The dealer's upcard is an 8-hearts. Jane hits and receives a 10-spades (for a point total of 16). Jane hits again and receives a 9-clubs. Since Jane's point total is over 21, Jane has busted and loses the main wager as well as the side wager still in play. Thus, Jane has originally wagered $2, won $3 in payouts, then lost the $2. Thus, Jane has made a profit of $1.

Ginger places a $2 main wager and a $1 side wager. Ginger is dealt a 7-clubs/2-diamonds. Since Ginger's point total is under 10, Ginger wins a payout of 3:1 ($3). Ginger's $1 side wager remains in play. The dealer's up-card is an ace-spades. The dealer asks for insurance, Ginger declines, the dealer checks for a natural and he does not have it; the game continues. Ginger hits and receives a 10-diamonds for a point total of 19 and stands. The dealer reveals the dealer's hole card to be a 9-spades, for a total of 20. Thus, Ginger loses the main game and her $2 main wager. Ginger also loses the $1 side wager still in play. Thus, Ginger wagered $3 originally, won $3 (on the initial side wager payout), and then lost $3 (when she lost the game), for an overall net gain/loss of zero.

Fred places a $1 main wager and a $2 side wager. Fred is dealt a 7-clubs/2-diamonds. Since Fred's point total is under 10, Fred wins a payout of 3:1 ($6). Fred's $2 side wager remains in play. The dealer's up-card is an ace-spades. The dealer asks for insurance, Fred declines, the dealer checks for a natural and he does not have it; the game continues. Fred hits and receives a 10-diamonds for a point total of 19 and stands. The dealer reveals the dealer's hole card to be a 7-spades, for a total of 18. Thus, Fred wins the main game (since Fred's point total of 19 is greater than the dealer's point total of 18) and wins an even money payout ($1) on his $1 main wager. Fred also now wins the $2 side wager still in play and wins a 2:1 payout ($4). Thus, Fred wagered $3 originally, won $1 on the main wager and won $10 ($6 initially plus $4 bonus) on the side wager, for a total of $14 in chips (a net win of $11) that Fred can now take from the table.

FIG. 4 is an illustration of possible paytables that can be used with the side wager described herein, according to an embodiment.

It can be appreciated that numerous other paytables can be devised as well (using different winning conditions and/or payouts). These are some examples.

In a further embodiment, a progressive jackpot can be offered. Progressive jackpots are known in the art, for example see U.S. Pat. Nos. 5,288,077, 5,364,105 and 5,577,731, all three of which are incorporated by reference herein in their entireties.

An additional progressive betting circle or slot (not pictured in FIG. 2B) can be used to collect the progressive wager (typically $1 but it can be another amount). A portion of the wager is used to fund the progressive jackpot (e.g., one cent for every $1 collected). Progressive jackpots can be specific for each individual table or different tables can be networked together with one common progressive jackpot for all. A digital display would typically be located on each table so that the players would know how much the progressive jackpot is worth at the time. If the player's hand and the dealer's hand meet a triggering condition, then a portion of the progressive jackpot pool is disbursed to that player. Table II below illustrates one example paytable for a progressive jackpot when a progressive wager is made (typically in operation 100). The question mark in the payout column means that any suitable value can be used. "Shortie" refers to a hand which is under a point total of 10. "Ace up" refers to an ace as the dealer's upcard. "K, Q, J, 10" refers to the dealer having one of these cards as the dealer's upcard.

TABLE II

| Player's hand | Dealer's hand | Payout % of progressive jackpot |
|---|---|---|
| Suited Aces | Blackjack same suit | 100% |
| Suited Aces | Blackjack different suit | 50% |
| Suited Aces | Ace up, same suit | 10% |
| Suited Aces | Ace up, different suit | ? |
| Suited Aces | K, Q, J, 10 | ? |
| Unsuited AA | Suited Blackjack | ? |
| Unsuited AA | Unsuited Blackjack | ? |
| Unsuited AA | Aces up | ? |
| Unsuited AA | K, Q, J, 10 | ? |
| Shortie | Suited Blackjack | ? |
| Shortie | Unsuited Blackjack | ? |
| Shortie | Ace up | ? |
| Shortie | K, Q, J, 10 | ? |
| All others | | no payout |

Table III is another example of a progressive jackpot paytable. The number in the "Total Score" column references to a point total of the player's initial two cards and the dealer's up card. "All unsuited" means that dealer's initial two cards are of different suit, while "all suited" refers to the dealer's initial two cards being of a same suit.

TABLE III

| Player's hand | Total Score (with Dealer's up card) | Payout % of progressive jackpot |
|---|---|---|
| Suited Aces | 3, all suited | 100% |
| Suited Aces | 3, unsuited | 50% |
| Suited Aces | 4, all suited | 30% |
| Suited Aces | 4, unsuited | 10% |
| Suited Aces | 5, 6 all suited | ? |
| Suited Aces | 5, 6 unsuited | ? |
| Suited Aces | 7, 8, 9 all suited | ? |
| Suited Aces | 7, 8, 9 all unsuited | ? |
| Shortie | 4, all suited | ? |
| Shortie | 4, unsuited | ? |
| Shortie | 5, 6 suited | ? |
| Shortie | 5, 6 unsuited | ? |
| All others | | no payout |

All of the methods described herein (except for the electronic versions) can be played with a physical deck of cards and physical chips (directly redeemable for cash) can be used in order to place and resolve wagers. The physical deck of cards can be one or more standard decks of 52 cards or other special decks. The games are played on a physical gaming table which is comprised of felt on top (with the layout printed on it), wooden legs, and other known components (e.g., chip rack, etc.) A mechanical electronic shuffling machine can also be used to shuffle the cards before dealing. Unless otherwise stated, all wagers placed herein can be any amount (subject to table minimum and maximum amounts).

Cards are given their standard numerical value. Aces count as one during operation 102, but otherwise can count as 1 or 11 depending on which would give the respective hand the better blackjack hand (highest total without busting). Cards 2 through 10 have a point total of the face value. Jacks, queens, and kings all have the numerical value of 10.

Any description of a component or embodiment herein also includes hardware, software, and configurations which already exist in the prior art and may be necessary to the operation of such component(s) or embodiment(s).

Further, the operations described herein can be performed in any sensible order. Any operations not required for proper operation can be optional. Further, all methods described herein can also be stored on a computer readable storage to control a computer.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A method to implement a blackjack game, the method comprising:

executing computer readable instructions on an electronic processing unit, the instructions performing:

providing a first rule set, which comprises if a player's initial two card hand is in a predetermined set of winning hands then the player wins a first payout on a side wager and the side wager remains in play, and if the player's initial two card hand is not in the predetermined set of winning hands then the player loses the side wager and the side wager is removed from play;

providing a second rule set, which comprises if the player wins a main wager then the player wins a second payout on the side wager, and if the slaver loses the main wager then the side wager is collected from the player;

receiving the main wager from a player;

offering the player an option to place the side wager, and receiving the side wager from the player;

dealing the player's initial two card hand and a dealer's initial hand;

resolving the side wager based on the first rule set;

completing the blackjack game and resolving the main wager; and resolving the side wager using the second rule set, wherein the player's initial two card hand is in the predetermined set of winning hands and the resolving the side wager based on the first rule set comprises paying the first payout on the side wager, and the player wins the main wager and the resolving the side wager using the second rule set comprises paying the second payout on the side wager.

2. The method as recited in claim 1, wherein the predetermined set of winning hands includes only hands that have a point total of less than a predetermined number.

3. The method as recited in claim 2, wherein the predetermined number is 10.

4. The method as recited in claim 3, wherein during the resolving the side wager based on the first rule, aces count only as 1.

5. The method as recited in claim 1, wherein the second rule set further provides that if the player's main wager is pushed then the player's the side wager is pushed.

6. The method as recited in claim 1, wherein the first payout is 3:1.

7. The method as recited in claim 1, wherein the second payout is 2:1.

8. A method to implement a blackjack game, the method comprising:

executing computer readable instructions on an electronic processing unit, the instructions performing:

providing a first rule set, which comprises if a player's initial two card hand is in a predetermined set of winning hands then the player wins a first payout on a side wager and the side wager remains in play, and if the player's initial two card hand is not in the predetermined set of winning hands then the player loses the side wager and the side wager is removed from play;

providing a second rule set, which comprises if the player wins a main wager then the player wins a second payout on the side wager, and if the slaver loses the main wager then the side wager is collected from the player;

receiving the main wager from a player;

offering the player an option to place the side wager, and receiving the side wager from the player;

dealing the player's initial two card hand a dealer's initial hand;

resolving the side wager based on the first rule set;

completing the blackjack game and resolving the main waver; and resolving the side wager using the second rule set, wherein the first rule set further provides that if the player's initial two card hand comprises two aces then the player is paid a bonus payout in addition to the first payout.

9. An electronic gaming apparatus to implement a blackjack game, the apparatus comprising:

a processing unit adapted to communicate with an output device and an input device, the processing unit configured to:

provide a first rule set, which comprises if a player's initial two card hand is in a predetermined set of winning, hands then the player wins a first payout on a side wager and the side wager remains in play, and if the player's initial two card hand is not in the predetermined set of winning hands then the player loses the side wager and the side wager is removed from play;

provide a second rule set, which comprises if the player wins a main wager then the player wins a second payout on the side wager, and if the player loses the main wager then the side wager is collected from the player;

receive the main wager from a player;

offer the player an option to place the side wager and receive the side wager if the player exercises the option;

deal the player's initial two card hand and a dealer's initial hand;

resolve the side wager, if placed, based on the first rule set;

complete the blackjack game and resolving the main wager; and resolve the side wager, if in play, using the second rule set, wherein the first rule set further provides that if the player's initial two card hand comprises two aces then the player wins a bonus payout in addition to the first payout.

10. The apparatus as recited in claim 9, wherein the predetermined set of winning hands includes only hands that have a point total of less than a predetermined number.

11. The apparatus as recited in claim 10, wherein the predetermined number is 10.

12. The apparatus as recited in claim 11, wherein during the resolve the side wager based on the first rule, aces count only as 1.

13. The apparatus as recited in claim 9, wherein the second rule set further provides that if the player pushes the main wager then the player pushes the side wager.

14. The apparatus as recited in claim 9, wherein the first payout is 3:1.

15. The apparatus as recited in claim 9, wherein the second payout is 2:1.

16. A method to implement a blackjack game, the method comprising:

executing computer readable instructions on an electronic processing unit, the instructions performing:

providing a first rule set, which comprises if a player's initial two card hand is in a predetermined set of winning hands then the player wins a first payout on a side wager and the side wager remains in play, and if the player's initial two card hand is not in the predetermined set of winning hands then the player loses the side wager and the side wager is removed from play:

providing a second rule set, which comprises if the player wins a main wager then the player wins a second payout on the side wager, and if the player loses the main wager then the side wager is collected from the player;

receiving the main wager from a player;

offering the player an option to place the side wager and receiving the side wager from the payer;

dealing the player's initial two card hand and a dealer's initial hand;

resolving the side wager based on the first rule set;

completing the blackjack game and resolving the main wager; and resolving the side wager using the second rule set, wherein the player's initial two card hand is in the predetermined set of winning hands and the resolving the side wager based on the first rule set comprising paying the first payout on the side wager, and the player loses the main wager and the resolving the side wager using the second rule set comprises collecting the side wager from the player.

17. A method to implement a blackjack game, the method comprising:

executing computer readable instructions on an electronic processing unit, the instructions performing:

providing a first rule set which comprises a first award set and a negative outcome set and an implementation rule set, the first award set comprising the player winning a first payout on a side wager and the side wager remains in play, and the negative outcome set comprises the player losing the side wager and the side wager is removed from play, the implementation rule set comprising if a player's initial two card hand is in a predetermined set of winning hands then the player wins a first award from the first award set and if the player's initial two card hand is not in the predetermined set of winning hands then the player receives a negative outcome from the negative outcome set;

providing a second rule set, which comprises if the player wins a main wager then the player wins a second award on the side wager, and if the player loses the main wager then the side wager is collected from the player;

receiving the main wager from a player;

offering the player an option to place the side wager which is a monetary amount, and receiving the side wager from the player;

dealing the player's initial two card hand and a dealer's initial hand;

resolving the side wager based on the first rule set;

completing the blackjack game and resolving the main wager: and resolving, the side wager using the second rule set, wherein the player's initial two card hand is in the predetermined set of winning hands and the resolving the side wager based on the first rule set comprises paying the first award on the side wager and the side wager remaining in play, and the player wins the main wager and the resolving the side wager using the second rule set comprises paying the second award on the side wager.

18. A method to implement a blackjack game, the method comprising:

executing computer readable instructions on an electronic processing unit, the instructions performing:

providing a first rule set which comprises a first award set and a negative outcome set and an implementation rule set, the first award set comprising the player winning a first payout on a side wager and the side wager remains in play, and the negative outcome set comprises the player losing the side wager and the side wager is removed from play, the implementation rule set comprising if a player's initial two card hand is in a predetermined set of winning hands then the player win a first award from the first award set and if the player's initial two card hand is not in the predetermined set of winning hands then the player receives a negative outcome from the negative outcome set;

providing a second rule set, which comprises if the player wins a main wager then the player wins a second award on the side wager, and if the player loses the main wager then the side wager is collected from the player;

receiving the main wager from a player;

offering the player an option to place the side wager which is a monetary amount, and receiving the side wager from the player;

dealing the player's initial two card hand and a dealer's initial hand;

resolving the side wager based on the first rule set;

completing the blackjack game and resolving the main wager; and resolving the side wager using the second rule set, wherein the player's initial two card hand is in the predetermined set of winning hands and the resolving the side wager based on the first rule set comprising paying the first award on the side wager, and the player loses the main wager and the resolving the side wager using the second rule set comprises collecting the side wager.

* * * * *